US007196268B2

(12) United States Patent
Vaughn

(10) Patent No.: US 7,196,268 B2
(45) Date of Patent: Mar. 27, 2007

(54) SELF SEALING ELECTRICAL CONNECTOR

(75) Inventor: James T. Vaughn, Greenville, SC (US)

(73) Assignee: ILSCO Corporation, Cincinnati, OH (US)

( * ) Notice: Subject to any disclaimer, the term of this patent is extended or adjusted under 35 U.S.C. 154(b) by 16 days.

(21) Appl. No.: 10/920,002

(22) Filed: Aug. 17, 2004

(65) Prior Publication Data

US 2006/0040541 A1 Feb. 23, 2006

(51) Int. Cl.
*H01R 4/00* (2006.01)

(52) U.S. Cl. ..... 174/84 C; 174/76

(58) Field of Classification Search ..... 439/877, 439/880; 174/74 R, 74 C, 84 R, 76, 84 C
See application file for complete search history.

(56) References Cited

U.S. PATENT DOCUMENTS 3,889,047 A * 6/1975 Carver ..... 174/84 R
3,937,870 A * 2/1976 Bumpstead et al. ..... 174/87
4,533,446 A * 8/1985 Conway et al. ..... 156/273.3
4,540,231 A * 9/1985 Forney, Jr. ..... 439/306
4,595,724 A * 6/1986 Koblitz ..... 524/409
4,722,471 A * 2/1988 Gray et al. ..... 228/265
4,797,509 A * 1/1989 Cook ..... 174/84 C
RE33,591 E * 5/1991 Feeny et al. ..... 156/85
5,070,597 A * 12/1991 Holt et al. ..... 29/887
5,098,319 A * 3/1992 McGaffigan et al. ..... 439/874
5,631,445 A 5/1997 Herster ..... 174/151
5,695,363 A 12/1997 Micheletti et al. ..... 439/578
6,454,598 B1 * 9/2002 Burwell et al. ..... 439/523
6,658,735 B1 * 12/2003 Ito ..... 29/868

FOREIGN PATENT DOCUMENTS

JP 11-97104 * 4/1999

* cited by examiner

*Primary Examiner*—Neil Abrams
(74) *Attorney, Agent, or Firm*—Charles L. Schwab; Nexsen Pruet, LLC

(57) ABSTRACT

An improved electrical butt connection is effected by a connector having anaerobic sealant which upon insertion of electric leads not only seals the connection against oxidation but also provides bonding which physically strengthens the connection. The connector is manufactured with an anaerobic sealant on the inside diameter of the end portions of the plastic cylindrical sheath extending axially beyond the axially opposite ends of the ferrule. Upon insertion of the electrical leads, the anaerobic sealant bonds and seals the outer cylindrical surface of the plastic sleeves of the lead wires to the cylindrical interior surface of the end portions of the cylindrical plastic sheath of the connector. The electrician need not carry a supply of the sealant. It is already in the connector.

4 Claims, 1 Drawing Sheet

SELF SEALING ELECTRICAL CONNECTOR

BACKGROUND OF THE INVENTION

This invention relates generally to the art of electrical connectors, and more particularly, to sealing an electrical connection in which a pair of aligned electrical conductors are conductively interconnected in a butt joint by a crimped ferrule.

Various connections have been devised for joining aligned electric conductors to one another including the use of a crimpable metal ferrule which is surrounded by an insulating sleeve. Even though the insulating sleeve has a close fitting relation with the insulation covering of the electrical conductors and with the ferrule, the sealing fit has not proven entirely satisfactory to prevent long term oxidation of the conductor terminals and ferrule.

BRIEF SUMMARY OF THE INVENTION

This invention provides an improved connection between a pair of aligned electric leads or conductors which provides an airtight seal and strain relief for the connection. A connector is provided having anaerobic sealant which not only provides an air tight seal for the connection but also bonds the conductor insulation to the plastic sheath surrounding the inner metallic ferrule of the connector. The improved connector is manufactured by a unique method which includes the step of applying anaerobic sealant to interior cylindrical surfaces at each end of the plastic sheath of the connector.

BRIEF DESCRIPTION OF THE DRAWINGS

This invention is illustrated by the accompanying drawings in which.

DETAILED DESCRIPTION OF THE INVENTION

Figure 1:
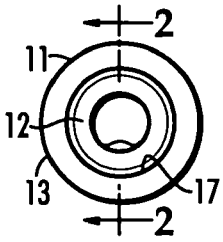
FIG. 1 is an end view of a connector for butt connecting a pair of electric leads.
Figure 2:
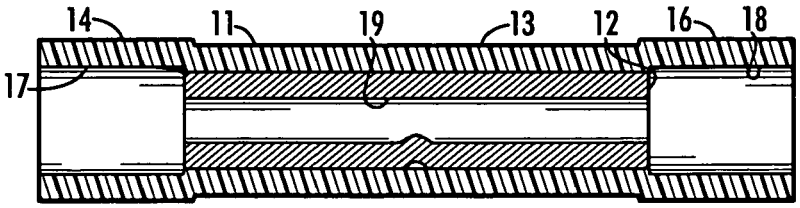
FIG. 2 is a section take on the line 2—2 in FIG. 1.

FIGS. 1 and 2 illustrate an electrical connector 11 having a tubular metal ferrule 12 encased in a heat shrunk plastic sheath 13 of tubular configuration. Opposite end portions 14, 16 of the tight fitting sheath 13 extend beyond the axially opposite ends of the ferule 12 and the present radially inward facing cylindrical surfaces 17, 18 adapted to receive the cylindrical insulation of aligned electric leads. The metal ferrule 12 has a cylindrical interior passage or central bore 19 extending between its axially opposite ends which is adapted to receive wires of the aligned electrical leads.

Figure 3:
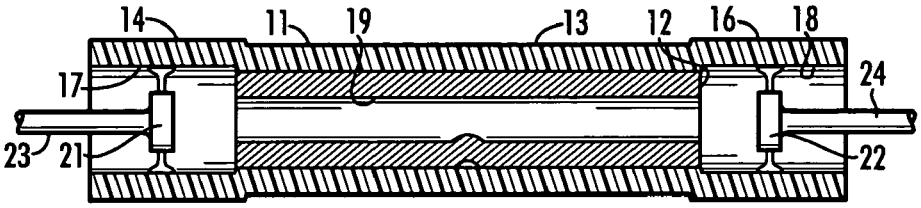
FIG. 3 is a section view similar to FIG. 2 showing application of sealant to the interior cylindrical surfaces at each end of the plastic sheath of the connector.

Referring to FIG. 3, a pair of sealant delivery nozzles 21, 22 have been inserted axially into the end portions 14, 16 of the plastic sheath 13 and are discharging a ring of anaerobic sealant in the form of a high viscosity gel to the cylindrical surfaces 17, 18, respectfully. Sealant is delivered from a pressurized source, not shown, by way of conduits 23, 24. After applying the sealant, the nozzles 21, 22 are withdrawn and adhesive gel rings 26, 27, formed by the application step of the manufacturing method, remain adhesively secured to the interior cylindrical surfaces 17, 18, respectively, of the plastic sheath 13. The connector 11 is now ready for packaging for distribution and marketing. The anaerobic sealant 26, 27 will remain in a gel state because of its exposure to oxygen in the air.

Figure 6:
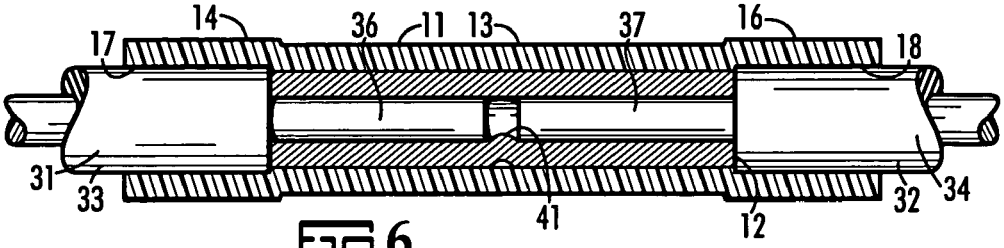
FIG. 6 is a section view of the connector showing electric leads inserted therein.
Figure 7:
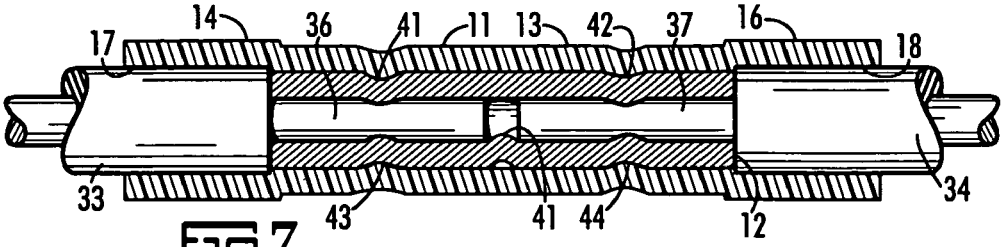
FIG. 7 is a view similar to FIG. 6 showing the metal ferrule of the connector crimped on the wires of the aligned leads.

FIGS. 6 and 7 illustrate steps in the use of the connector 11. A pair of aligned electric leads 31, 32 have had the encasing tubular plastic insulation 33, 34 removed from confronting ends of their cylindrical conductors or wires 36, 37 a sufficient distance to place their confronting ends near a dimple 41 at the longitudinal center of the metal ferrule 12. Insertion of the cylindrical insulation sleeves 33, 34 into the openings in the sheath 13 formed by the radially inward facing cylindrical surfaces 17, 18 spreads the anaerobic adhesive 26, 27 between the radially confronting cylindrical surfaces of the sleeves 33, 34 and the cylindrical surfaces 17, 18 and at the same time cuts off the supply of oxygen to the anaerobic sealant. In absence of oxygen, the anaerobic adhesive solidifies and bonds the cylindrical exterior surfaces of the sleeves 33, 34 to the cylindrical interior surfaces 17, 18 of the plastic sheath 13 of the conductor 11. This bonding of the sleeves 33, 34 to the sheath 13 adds mechanical strength to the connection between the leads 31, 32. Strain relief is thus afforded for the physical connection effected by the crimping of the ferrule 12 in the next manufacturing step shown in FIG. 7, which results in indentations 41, 42, 43, 44 in the ferrule 12.

Figure 4:
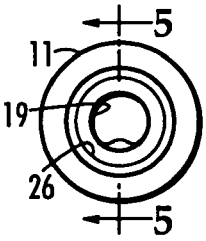
FIG. 4 is an end view of the connector after application of the sealant.
Figure 5:
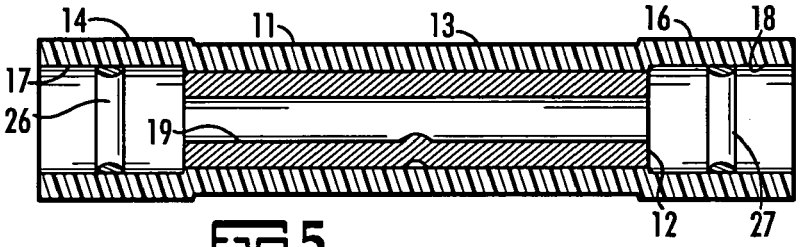
FIG. 5 is a section take on the line 5—5 in FIG. 4.

The connector illustrated in FIGS. 4 and 5, as manufactured by the herein outlined method, is ready for use in making an electrical butt connection. The anaerobic sealant 26 27 remains in gel form until deprived of oxygen, which occurs upon insertion of the leads 31, 32. The anaerobic sealant not only seals the connection thereby preventing oxidation of the metal ferrule and lead wires but also bonds the sleeves of the leads to the sheath of the ferrule, thus physically strengthening the connection.

What is claimed is:

1. A connector for butt connecting a pair of electrical leads each of which has a conductor wire encased in a cylindrical plastic insulation sleeve having a radially outer cylindrical surface with a portion of the plastic insulation removed to expose an end portion of the wire, said connector comprising:

a tubular crimpable metal ferrule with a cylindrical interior passage extending between its axially opposite ends adapted to receive said exposed end portions, respectively, of said conductor wires of said pair of electrical leads, a plastic cylindrical sheath encompassing said ferrule in a tight fitting stationary manner and having end portions extending axially outward beyond said opposite ends, respectively, of said ferrule and presenting radially inward facing cylindrical surfaces adapted to receive said cylindrical insulation sleeves of said pair of leads, respectively, and an anaerobic sealant adhered to each of said radially inward facing cylindrical surfaces of said plastic sheath, said anaerobic sealant providing an adhesive and sealing engagement between said radially inward facing cylindrical surfaces of said plastic sheath and said radially outer cylindrical surfaces of said insulation, respectively, without application of heat, when said conductor wires are inserted into said interior passage of said ferrule to isolate said anaerobic sealant from the surrounding oxygen containing atmosphere to cause said anaerobic sealant to set solely due to the absence of oxygen and within said plastic cylindrical insulation sleeve.

2. The connector of claim 1 wherein said sealant is in the form of a ring on each of said radially inward facing cylindrical surfaces of said plastic sheath.

3. A connector adapted for connection to an electrical lead having a conductor wire encased in a cylindrical plastic insulation sleeve with a radially outer cylindrical surface and with a portion of the insulation sleeve removed to expose a bare end portion of the conductor wire, said connector comprising:

a tubular ferrule having a cylindrical interior passage with an end adapted to receive said bare end portion of said conductor wire, a plastic cylindrical sheath encompassing said ferrule in a tight fitting stationary manner and having an end portion extending axially outward beyond said end of said ferrule, said end portion presenting a radially inward facing cylindrical surface adapted to receive said insulation sleeve of said lead, and an anaerobic sealant adhered to said radially inward facing cylindrical surface of said plastic sheath, said anaerobic sealant providing an adhesive and sealing engagement between said radially outer cylindrical surface of said insulation sleeve and said radially inward facing cylindrical surface of said plastic sheath without application of heat when said bare end portion of said conductor wire is inserted into said interior passage of said ferrule to isolate said anaerobic sealant from the surrounding oxygen containing atmosphere to cause said anaerobic sealant to set solely due to the absence of oxygen and within said plastic cylindrical insulation sleeve.

4. The connector of claim 3 wherein said sealant is in the form of a ring on said radially inward facing cylindrical surface of said end portion of said plastic sheath.

* * * * *